US006250507B1

(12) United States Patent
Ekkert

(10) Patent No.: US 6,250,507 B1
(45) Date of Patent: Jun. 26, 2001

(54) CONTAINER CAP WITH LOCKING COVER

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 09/428,187

(22) Filed: Oct. 27, 1999

(51) Int. Cl.[7] ..... B67B 5/00
(52) U.S. Cl. ..... 222/153.14; 222/480
(58) Field of Search ..... 222/153.14, 480, 222/482, 545, 556; 220/254, 259, 824, 326, 833, 834, 835

(56) References Cited

U.S. PATENT DOCUMENTS

| | | | | |
|---|---|---|---|---|
| D. 278,602 | | 4/1985 | Rosenstein | D9/449 |
| 4,303,176 | * | 12/1981 | Swatzbaugh | 222/565 |
| 4,693,399 | | 9/1987 | Hickman et al. | 222/480 |
| 4,714,181 | | 12/1987 | Kozlowski et al. | 222/480 |
| 4,898,292 | | 2/1990 | VerWeyst et al. | 215/237 |
| 4,925,067 | | 5/1990 | Zemlo et al. | 222/480 |
| 4,936,494 | | 6/1990 | Weidman | 222/480 |
| 5,139,181 | | 8/1992 | VerWeyst | 222/480 |
| 5,219,100 | | 6/1993 | Beck et al. | 222/480 |
| 5,636,732 | * | 6/1997 | Gilels et al. | 222/480 |
| 5,752,615 | * | 5/1998 | Hofmann et al. | 222/482 |
| 5,788,108 | * | 8/1998 | Rohr | 222/556 |
| 5,799,838 | * | 9/1998 | Miller | 222/480 |

* cited by examiner

*Primary Examiner*—Philippe Derakshani
*Assistant Examiner*—Thach H Bui
(74) *Attorney, Agent, or Firm*—Welsh & Katz, Ltd.

(57) ABSTRACT

A locking closure for use with an associated container includes a closure cap having a top wall portion and a depending skirt portion depending from the top wall portion. The top wall portion further defines a dispensing region therein, and a door for covering the dispensing region. The door has a top surface and a bottom surface defining a thickness, and the door is connected to the top wall portion at a hinge region. The door is pivotable about the hinge region to traverse a path between an open condition and a closed condition. The closure includes a latch having a base portion integral with the top wall that extends generally transverse therefrom. The latch further includes a hook portion integral with the base portion, the hook portion extending from the base portion and intersecting the path defined by the door. The hook portion is spaced from the top wall and defines an engaging surface and a locking surface. The locking surface generally opposes the top wall portion, and the engaging surface inclines downward as it extends toward the door. The locking surface maintains the door in the closed condition and the engaging surface is configured to urge the hook portion out of the path of the door during closing of the door.

22 Claims, 4 Drawing Sheets

CONTAINER CAP WITH LOCKING COVER

FIELD OF THE INVENTION

This invention relates to a container cap. More particularly, the invention relates to a dispensing-type container cap having dual, inwardly opening, locking, non-interfering door-type doors.

BACKGROUND OF THE INVENTION

Containers having a dispensing-type cap are known in the art. One type of dispensing container includes a threaded closure cap (an over-cap) and a perforated fitment fit onto the container, below the cap, for dispensing the contents of the container. Such an arrangement may be used, for example, for storing and dispensing herbs and spices.

One variation of this type of container includes a fitment having a relatively large opening for dispensing or spooning large (e.g., poured or measured) amounts of the contained material, in combination with a plurality of relatively small perforations or openings in the fitment for non-measured dispensing (e.g., shaking or sprinkling) of the material from the container.

Another known type of container closure includes a cap having doors, doors or covers hingedly mounted to the cap. The doors are positioned on the cap to share a hinge portion that extends across the cap, generally through the center thereof. Alternately, the hinge portions of the known dual-door type caps may be positioned separated from one another in back-to-back relation relative to each other, with the area between the doors defining a hinge region. When closed, the doors retard spoilage and can extend the life of the material stored in the container.

These door-type caps eliminate the need for an additional cap element (e.g., an over-cap) covering the dispensing portion. Although such caps eliminates one or more member from the closure assembly, generally, the doors are somewhat subject to being accidentally jarred open. This is especially true of caps which have desirable grasping extensions. Such grasping extensions ease the consumer's opening of the container, but also offer a projection which subjects a container to accidental opening.

Further, locking mechanisms for a door-type cap can pose stacking and storage problems when a locking mechanism extends above the rim of a cap. For the retail sales environment it is important that a locking mechanism facilitates the easy stacking of the capped products on store shelves.

Accordingly, there exists a need for a door-type closure cap for a container which eliminates the need for an over-cap while permitting both measured and shaken dispensing of material from the container. Preferably, such a cap includes improved means for keeping the doors closed despite external stresses, while facilitating stacking and display in the retail environment.

SUMMARY OF THE INVENTION

The present invention relates to closures for containers which have locking flap-like doors. One embodiment of the present invention contemplates a locking closure for use with an associated container is a closure cap having a top wall portion and a depending skirt portion depending from the top wall portion. The top wall portion has a dispensing region, and a door for covering the dispensing region. The door has a top surface and a bottom surface defining a thickness. The door is connected to the top wall portion at a hinge region, and the door is pivotable about the hinge region to traverse a path between an open condition and a closed condition. The locking closure also has a latch with a base portion integral to the top wall extending generally transverse therefrom. The latch includes a hook portion integral with the base portion, with the hook portion extending from the base portion and intersecting the path of the door, with the hook portion being spaced from the top wall. The hook portion has an engaging surface and a locking surface, with the locking surface generally opposing the top wall portion, and the engaging surface inclining downward as it extends toward the door. The locking surface maintains the door in the closed condition and the engaging surface is configured to urge the hook portion out of the path of the door during closing of the door.

In a preferred embodiment the hook portion is spaced from the top wall portion by a distance substantially equal to the thickness of the door. In this embodiment, the latch abuts the top surface of the door and the top wall portion abuts the bottom surface of the door when the door is in the closed condition.

In one embodiment, the door has an edge, and the door defines a deflecting surface which extends from the edge to the bottom surface. In this embodiment, the deflecting surface abuts the engaging surface and exerts a force thereon during closing, while providing an arcuate or sloped contact between the door and the engaging surface.

In another embodiment, the deflecting surface is an inclined plane.

In a further embodiment, the deflecting surface extends upwardly and outwardly from the bottom surface at an angle between 15° and 75°.

In a still further embodiment, the deflecting surface extends upwardly and outwardly from the bottom surface at an angle between 35° and 55.

In yet a still further embodiment the deflecting surface extends upwardly and outwardly from the bottom surface at an angle of about 45°.

In another embodiment, the door has an edge and defines an unlocking surface. The unlocking surface extends from the top surface of the door to the edge of the door such that the hook portion locking surface abuts the door unlocking surface when the door is in the closed condition and exerts a force thereon to maintain the door in the closed condition.

In still another embodiment, the hook portion is spaced from the top wall portion by a distance substantially equal to a distance between the bottom surface and the unlocking surface, and the latch abuts the unlocking surface while the top wall portion abuts the bottom surface of the door when the door is in the closed condition.

Alternatively, the hook portion locking surface is upwardly inclined relative to the top wall portion.

In yet another embodiment, the top wall defines a first plane, and the locking surface defines a second plane and the angle between first plane and the second plane is about 10°.

In a still further embodiment, the engaging surface has an arcuate configuration.

In yet another embodiment, the engaging surface has a radial configuration.

In yet another still further embodiment, the latch tapers inwardly as it extends upwardly from where the base portion connects to the top wall portion, so that the hook portion is more easily urged away from the door.

In still another embodiment, a locking closure has a rim integral with the top wall portion and extending upwardly therefrom away from the skirt portion.

Alternatively, a locking closure has a rim having a top spaced from the top wall portion by a first height above the top wall portion, and the latch extends upwardly to a second height above the top wall portion less than or equal to the first height.

In yet another alternative embodiment, the latch is spaced from the hinge region.

In a still further embodiment, the locking closure has a second latch which is spaced from the latch and spaced from the hinge region.

In a still yet further embodiment, the top wall portion defines a secant line and a periphery, and the door has a secant edge adjacent to the secant line and a peripheral edge adjacent to a portion of the periphery.

In yet another embodiment, the locking closure has a first latch and a second latch, the first latch engaging the door on the secant edge and the second latch engaging the door on the peripheral edge.

In another embodiment, the latch is configured to cooperate with the door to render an audible indication that closing is complete.

Other features and advantages of the present invention will be apparent from the following detailed description, the accompanying drawings, and the appended claims

DETAILED DESCRIPTION OF THE PREFERRED EMBODIMENTS

Figure 1:
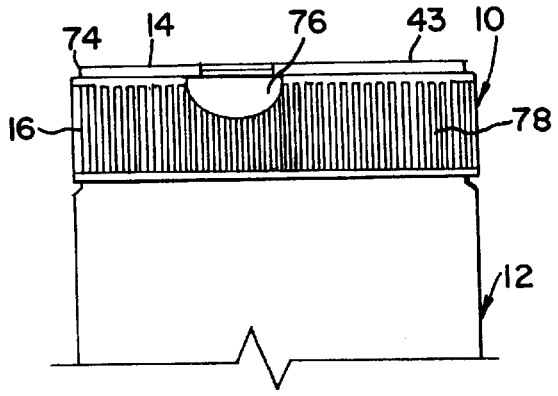
FIG. 1 is a front elevational view of a dual opening container cap embodying the principles of the present invention, illustrated atop a container, the cap being shown so as to illustrate the recessed region.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a dual-opening container cap 10 embodying the principles of the present invention. The cap 10 is illustrated positioned on a container 12. The cap 10 includes a circular top wall portion 14 and a depending annular skirt portion 16 depending from the top wall portion 14.

Figure 2:
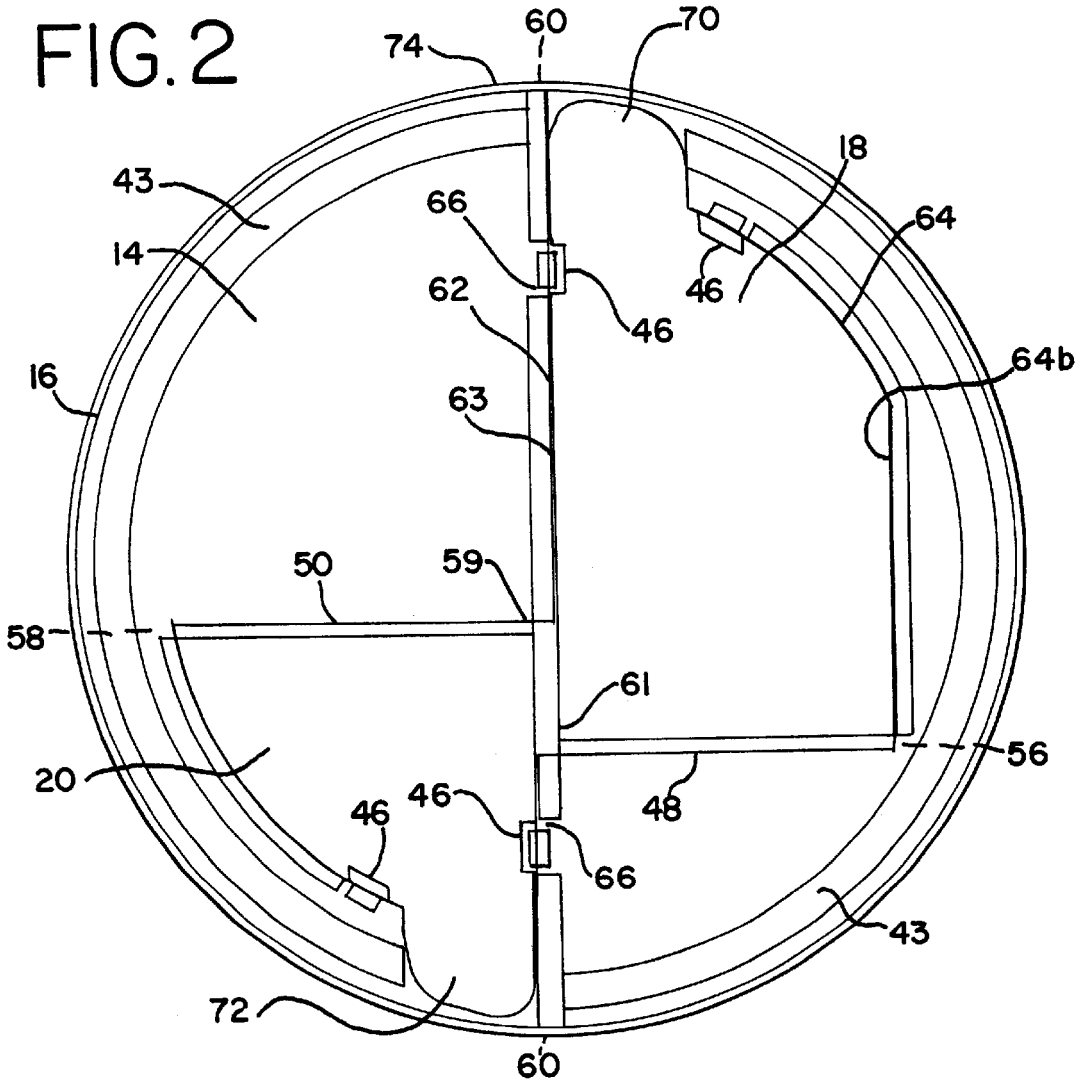
FIG. 2 is a top view of a dual opening container cap embodying the principles of the present invention, the cap being shown with the doors or covers held in the closed position by the latches.
Figure 3:
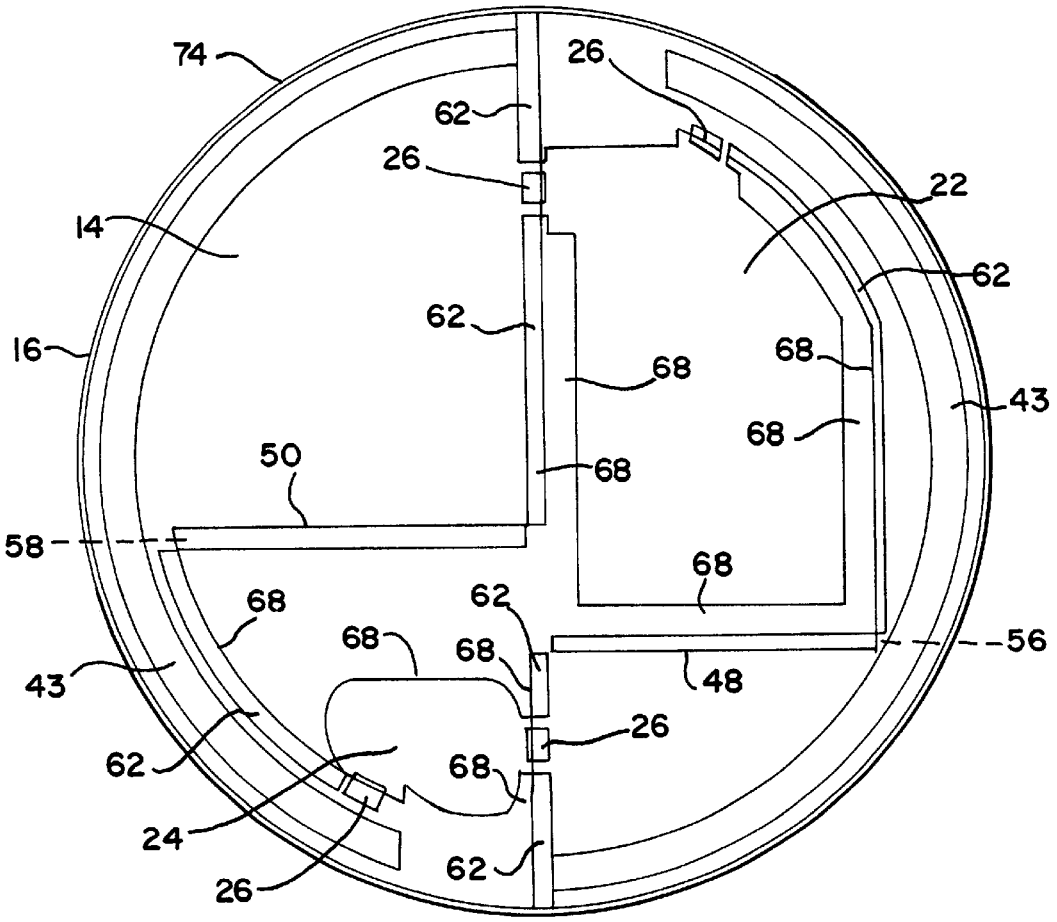
FIG. 3 is an alternate embodiment of the cap of FIG. 2 shown with the doors removed for clarity of illustration.

Referring to FIGS. 2–3, the cap 10 has first and second flaps, covers or doors 18, 20 that cover first and second dispensing openings, 22, 24, respectively. It is anticipated that the cap 10 will be used for containers storing, for example, foodstuffs such as condiments, herbs and spices, and powdered goods, such as powdered coffee creamer. Because the characteristics, e.g., size and shape, of the foodstuffs stored in the container 12 can vary considerably, the dispensing openings 22, 24 can be provided in various forms and sizes.

On the top wall portion 14 of the cap 10, adjacent to each of the dispensing openings, 22, 24 is at least one latch 26. Preferably, as illustrated in FIG. 2, pairs of latches 26 are associated with each door 18, 20. Latches 26 are placed to engage and lock the respective doors 18, 20 over the respective openings 22, 24. As illustrated in a preferred embodiment, the pair of latches 26 for a particular door 18 or 20 are spaced from one another and on opposing sides of the door.

As illustrated in FIGS. 4–5 and 9*a–b* & 10, each door 18, 20 has a top surface 28, a bottom surface 30, and one or more edges or sides 32. Each door 18, 20 preferably has deflecting surfaces 44 and unlocking surfaces 46 defined near the edges or sides 32 of the door 18, 20 to facilitate locking and unlocking by the door's 18, 20 respective latch or latches 26. The edges or sides 32 have heights that match the thickness 33 of the door 18, 20, which is defined by the distance between the top surface 28 of the door 18, 20 and the bottom surface 30 of the door 18, 20. Such deflecting surfaces 44 and unlocking surfaces 46 are located on the door 18, 20 such that they interact with the latches 26 when the door 18, 20 is closed or closing in the case of the deflecting surfaces 44, or opening in the case of the unlocking surfaces 46.

Figure 5:
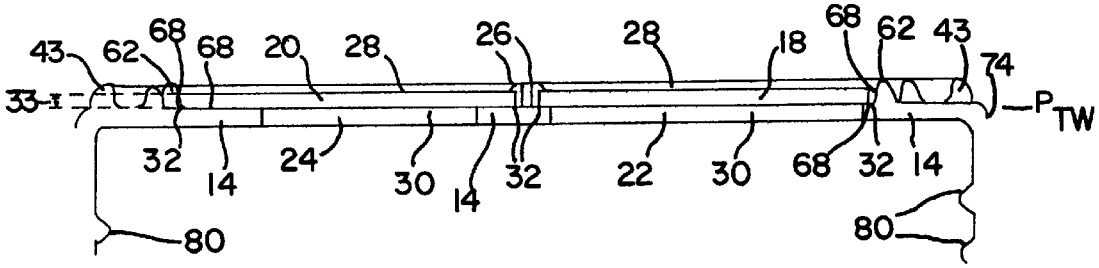
FIG. 5 is a side cross-sectional view of the cap in FIG. 1, which shows the latches holding the doors or covers in the closed position.
Figure 6:
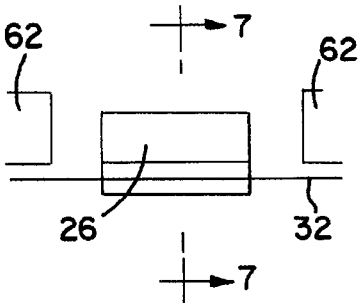
FIG. 6 is an enlarged elevational view of a latch, set in the middle of a rib, holding down the cover.

As shown in FIGS. 2–3 and 5, in the illustrated embodiment, a latch 26 is integral with the top wall portion 14. The latch 26 includes a base portion 34 that is attached to the top wall 14, and a hook portion 36 spaced from the top wall 14 by the base 34 a distance substantially equal to the thickness of the associated door 18, 20. The hook 36, supported by the base 34, extends toward its associated door 18, 20 generally parallel to the top wall 14. In a preferred embodiment, the spacing between the top wall 14 and the hook 36 is adjusted for the depth of an associated unlocking surface 46 defined by the associated door 18, 20.

Figure 7A:
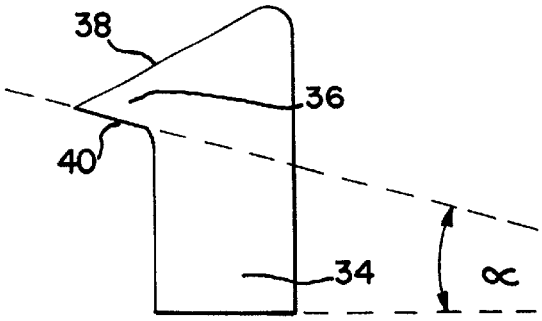
FIGS. 7*a–c* are cross-sectional views of the latch taken along line 7—7 of FIG. 6, FIG. 7*a* has a sloped upper edge, FIG. 7*b* has an arcuate upper edge, and FIG. 7*c* has a radial upper edge.
Figure 7B:
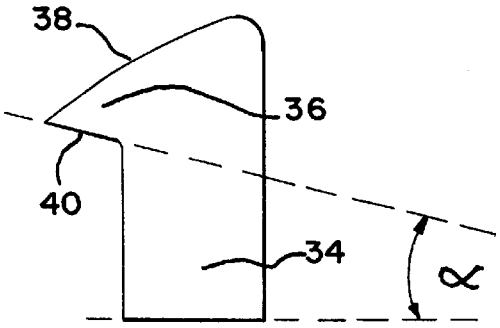
Figure 7C:
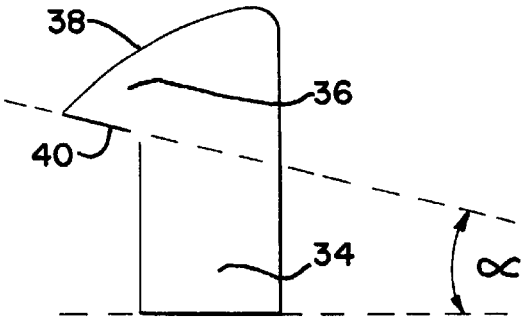
Figure 8:
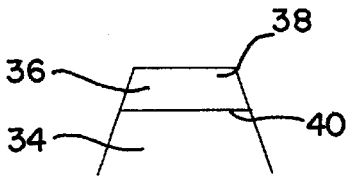
FIG. 8 is a front view of the latch portion.

Illustrated in profile in FIGS. 7*a–c,* the hook 36 has an upper, inclined, engaging surface (or upper edge) 38, and a lower locking surface (or lower edge) 40 in opposing relation to the engaging surface 38. The lower locking surface 40, stands approximately in opposition to the plane of the top wall 14, and the upper, inclined, engaging surface 38 that faces away from the top wall 14. As shown in FIGS. 5 and 8, the hook portion 36 projects from the base portion 34 roughly parallel to the plane $P_{TW}$ of the top wall portion 14. As will be understood from the figures, the locking surface 40, and the engaging surface 38 overlap the path of the door 52, 54 during opening and closing of the door 18, 20.

Referring to FIGS. 7*a–c,* preferably, the locking surface 40 slopes upward away from the top wall portion 14 as it extends away from the base portion 34 to facilitate unlocking the door 18, 20 from the latch 26. Most preferably, the angle $\alpha$ between the plane of the top wall portion 14 and the plane of the locking surface is about 10°. The locking surface 40 is positioned to engage the door 18, 20 to maintain the door 18, 20 fully covering its associated dispensing opening 22, 24. When the locking surface 40 is sloped, the thickness of the door 18, 20 can exceed the narrowest distance between the locking surface 40 and the top wall portion 14. The excess thickness of the door 18, 20 will exert a slight force on the latch 26, which force is applied by the latch 26 to hold the door 18, 20 down firmly.

FIGS. 7*a–c* also show the upper engaging surface 38. The engaging surface 38 of the latch 26 is sloped or inclined at an angle relative to the top wall portion 14 to facilitate closing the door 18, 20. The slope of the engaging surface 38 descends toward the top wall portion 14 as the engaging surface 38 extends away from the base portion 34. The preferred radial upper edge 38, shown in FIG. 7*c*, is a radius equal to the distance from the upper edge 38 to the top wall portion 14. Other inclines, such as a planar incline, illustrated in FIG. 7*a*, or an arcuate configuration, shown in FIG. 7*b*, will be apparent to skilled workers and are contemplated by the present invention. The engaging surface 38, in any event, can be configured so that an angle of contact exists between the door 18, 20 and the engaging surface 38 such that the latch 26 is constantly deflected from the path of the descending door 18, 20 by the force of contact.

Preferably, the latch 26 is more rigid where it connects to the top wall portion 14 and less rigid (e.g. more flexible) toward the top 28 of the upper, inclined, engaging, surface 38. FIG. 8 depicts a head-on view of the latch 26 with the hook portion 36 pointing directly at the viewer. The preferred variation in rigidity is accomplished by forming the latch 26 with a taper which begins at the point where the latch 26 connects and ends at the top wall portion 14 to the top of the latch 26. As can be seen the latch 26 of FIG. 8 can thin as it rises upward. Most preferably, the latch 26 tapers in the dimension perpendicular to the projection of the hook portion 36. That is, the latch 26 tapers inwardly as it extends upwardly away from the top wall 14. The tapering of the latch 26 facilitates closing the door 18, 20 because the thinner material near the top of the latch 26 allows a downward force exerted on the upper edge 38 to urge the hook portion 36 away from the door 18, 20 more readily. The tapering of the base portion 34 also facilitates opening the door 18, 20 because the thinner material near the top of the latch 26 allows an upward force exerted on the lower edge 40 of the hook portion 36 to urge the hook 36 away from the door 18, 20.

As shown in FIG. 5, in a preferred embodiment, the upper edge 38 of the latch 26 is at or below the top of the rim 43 of the cap 10. This facilitates stacking capped container units for merchandising, display, storage, shipping and the like. When the latch 26 is at or below the top of the rim 43 of the cap 10, the rim 43 also protects the latch 26 from breakage.

Figure 9A:
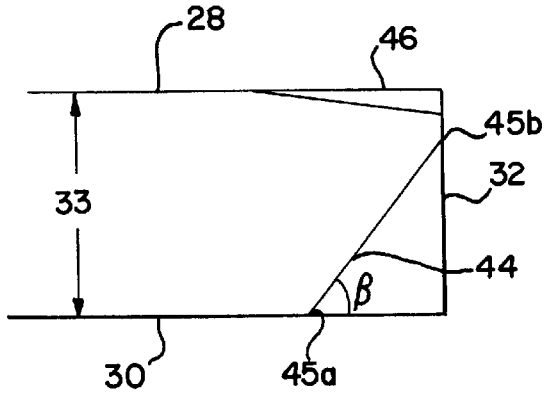
FIGS. 9*a–b* are views of the edge region of the door with a deflecting surface and an unlocking surface.
Figure 9B:
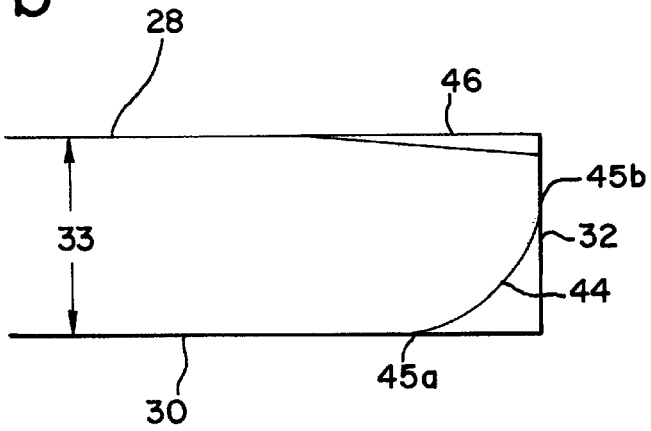
Figure 10:
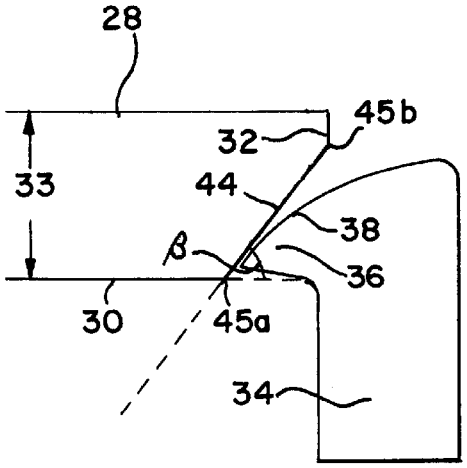
FIG. 10 is an illustration of the door and the latch in contact.

Referring to FIGS. 9*a–b* & 10, the doors 18, 20 can each include a deflecting surface 44 in the edge of the door 18, 20. The deflecting surface 44 is positioned on the door 18, 20 such that during closing of the door 18, 20, the door 18, 20 exerts a force on the engaging surface 38 of the latch 26. When the deflecting surface 44 exerts a force on the engaging surface 38 the deflecting surface 44 urges the hook portion 36 away from the door 18, 20. The illustrated deflecting surface 44, for example, provides an arcuate or tapered contact between the engaging surface 38 of the latch 26 and the door 18, 20 during the closing of the latch 26 to facilitate closing. By presenting a plane for contact to the engaging surface 38, the deflecting surface 44 facilitates smoother closing of the door 18, 20. It is preferred that the deflecting surface 44 present a plane for contact at all times during the closing so as to have substantial structural stability to resist curling and indentation of the deflecting surface 44.

The deflecting surface 44 of the door 18, 20 runs from the bottom of the door 30 to the edge 32 of the door 18, 20. The deflecting surface 44 is inclined so that the deflecting surface 44 extends downwardly toward the top wall portion 14 as the deflecting surface 44 extends toward its associated door 18, 20. Preferably, as seen in FIG. 10, a thickness of the door remains along the edge 32 to resist wear and curling of the edge from repeated openings and closings. Preferably, above the deflecting surface 44, the edge 32 and the top surface 28 meet at approximately a right angle.

The deflecting surface 44 as per FIGS. 9*a–b* & 10 is an angled surface which is angled upwardly and outwardly relative to the bottom surface 30 at an angle β of 15°–75°, more preferably in the range of 35°–55°, and most preferably approximately 45°. Preferably, the deflecting surface 44 meets the bottom surface 30 at a bottom intersection 45*a*, which is spaced inwardly from the edge 32 as far or farther than the hook portion 36 projects into the path of the door 52, 54. Further, preferably, the deflecting surface 44 intersects the edge 32 of the door 18, 20 at an edge intersection 45*b* spaced beneath the top surface 28 of the door 18, 20. Such spacing provides strength for the door to resist curling and denting through repeated openings and closings. Preferably, the spacing between the top surface 28 and the intersection 45 of the edge and the deflecting surface is about 0.02"–0.10", spacing of about 0.04" being most preferred.

The deflecting surface 44 between the bottom intersection 45*a* and the edge intersection 45*b* is preferably an inclined plane, as shown in FIG. 9*a*, but various other shapes such as arcuate or radial surfaces, as shown in FIG. 9*b*, will be apparent to those skilled in the art and are contemplated by the present invention.

As shown in FIGS. 9*a–b*, a door 18, 20 can also define an unlocking surface 46. The unlocking surface 46 is defined by the top of the door 28 having an inclined surface which can approximately parallel the locking surface 40 of the latch 26. The unlocking surface's 46 incline is such that the unlocking surface 46 is closer to the top wall portion 14 the nearer it is to the edge (or side) 32 of the door 18, 20. The unlocking surface 46 is located such that when the door 18, 20 is in the closed position, the unlocking surface 46 abuts the locking surface 40 of the latch 26. When the door 18, 20 is opened, the unlocking surface 46 exerts a force on the locking surface 40, pushing the latch 26 away from the door 18, 20.

Figure 4:
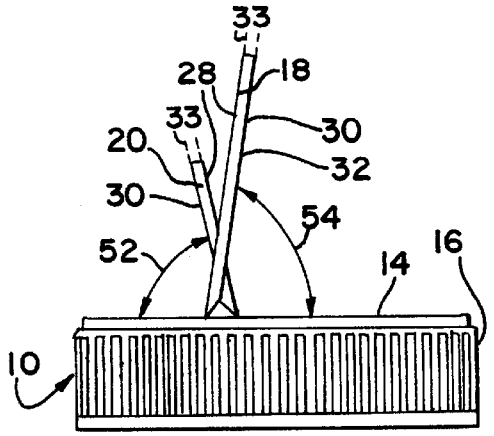
FIG. 4 is an elevational view of the cap illustrated with the doors in the open position.

The doors 18, 20 are connected to the top wall portion 14 at respective hinges 48, 50. The hinges 48, 50 are preferably spaced from the latches 26. The hinges 48, 50 permit the doors 18, 20 to be rotated or pivoted upwardly, from the top wall portion 14, and downwardly onto the top wall portion 14, between an open position and a closed position, as indicated by the arrows at 52 and 54 in FIG. 4. The doors 18, 20 in FIG. 4 are viewed edge on, with each door 18, 20 having a top surface 28 that faces away from the respective dispensing opening 22, 24, and a bottom surface 30 that faces towards the respective opening 22, 24.

Referring now to FIG. 2, each hinge 48, 50 defines a hinge line 56, 58. The hinge lines 56, 58 each extend essentially coextensive with the axis of rotation of the door 18, 20. The hinge lines 56, 58 are spaced from one another and preferably are parallel to one another. Advantageously, the parallel and spaced positioning of the hinge lines 56, 58 relative to one another define hinges 48, 50 that are bidirectionally spaced from each other. That is, when the hinges 48, 50 are viewed relative to a secant line 60 traversing the cap 10, the hinges 48, 50 are positioned on opposite sides of the secant line 60 and the hinge lines 46, 48 intersect the secant line 60 at different points, as illustrated at 59 and 61, respectively. Preferably, the hinge lines 46, 48 are perpendicular to the secant 60.

Preferably, in embodiments where a cap 10 has multiple latches 26, each door 18, 20 has a deflecting surface 44 and an unlocking surface 46 associated with each latch 26. The location of a latch 26 on the top wall portion 14 of the cap 10 determines the appropriate location of the associated deflecting surface 44 and unlocking surface 46 on the latch 26. The deflecting surface 44 and unlocking surface 46 should be located on the door 18, 20 so that the deflecting 44 and unlocking surfaces 46 interact with the latch 26 during opening and closing.

In a preferred embodiment the doors 18, 20 have at least two edges 32. Referring to FIG. 2, a secant edge 63 is adjacent to a secant line 60 traversing the top wall portion 14. A peripheral edge 64 shadows the curvature of the cylindrical cap 10 with a lesser radius for at least a portion of the peripheral edge's 64 length. Two peripheral edges 64 are illustrated in the closure 10 of FIG. 2.

A first peripheral edge 64 can shadow the circumference of the top wall portion 14 for the edge's entire length as an illustrated short door 20 does. Alternatively, a second peripheral edge 64 can shadow the circumference of the top wall portion 14 for only a portion of the edge's length, and thereafter parallel the secant edge 63 as shown at 64*b* of the longer door 20 in FIG. 2. When, as in the illustrated embodiment, the door 18, 20 has multiple edges, it is preferable that each of the latches 26 lock on to a different edge of the door 18, 20.

In the illustrated embodiment of FIGS. 2–3, a latch 26 used to lock a door 18, 20 along the door's secant edge 63 is preferably located at a distance about equal to 40 percent of the radius of the cap 10 inward from the edge of the top wall portion 14 along the secant edge 63. Similarly, a latch 26 used to lock a door 18, 20 along the door's peripheral edge 64 is preferably located along the peripheral edge 64 at an angle about equal to thirty degrees from the center of the top wall 14 relative to the secant edge 63 of the cap 10.

In a current embodiment, shown in FIGS. 2 and 7*a*–*c*, the dispensing openings 22, 24 are separated from one another by a separating portion, such as the exemplary rib 62, extending across the cap 10. Ribs 62 may also separate the openings from the rim 43. Preferably, latches 26 associated with the secant edge 63 of the door 18, 20 will be located in a gap 66 defined by the rib 62.

The rib 62 can be configured to provide additional structural strength to the cap 10, and can also provide a portion of a sealing surface 68 against which the doors 18, 20 close, to provide a seal for the container 12 contents. The sealing surface 68 illustrated is formed in the plane of the top wall portion $P_{TW}$, to seal the dispensing openings 22, 24 by the contact of the bottom surface 30 of the door and an adjacent and touching portion of the top wall 14 when the door is closed. The sealing surface 68 can be can be augmented by the rib 62 to extend the sealing surface 68 upward from the top wall 14 and adjacent to the side of the door 32.

The seal between the doors 18, 20 and the sealing surfaces 68 can help maintain the container 12 contents fresh and prolong the life thereof. The seals between the doors 18, 20 and the sealing surfaces 68 can also prevent the introduction of foreign matter and contaminants into the container 12.

Optionally, the doors 18, 20 can include grasping extensions 70, 72 that extend therefrom toward the periphery 74 of the cap 10. The grasping extensions 70, 72 ease opening the doors 18, 20 by providing an area for a user to grasp or engage the doors 18, 20 and urge the doors 18, 20 upward to the open position. The extensions 20, 22 also provide additional leverage for unlocking the door 18, 20 from its respective latch or latches 26.

As illustrated in FIG. 1, the cap 10 can also include recessed or indented regions 76 (one shown), formed in the outer surface 78 of the skirt portion 16, at the juncture of the skirt portion 16 and the top wall portion 14, adjacent to the grasping extensions 70, 72. The recessed regions 76, in conjunction with the extensions 70, 72, facilitate easy opening of the doors 18, 20 by providing areas for applying finger pressure to the extensions 70, 72 to urge the doors 18, 20 upward.

The cap 10 as illustrated includes internal threads 80 formed in the depending skirt portion 16 for engaging a complementary thread formed on a container 12. It will, however, be recognized by those skilled in the art that the present cap 10 can be formed so as to snap onto a container 12, or the cap 10 can be made to mate with or engage an associated container 12 in a variety of other confgurations. All such configurations of engaging the cap 10 with the container 12 are within the scope of the present invention.

The door 18, 20 opens and closes by pivoting on the: hinges 48, 50 located in the hinge 48, 50 region.

In closing the door 18 or 20, the door's edge 32, vis-à-vis the inclined deflecting surface 44, imposes force a on the engaging surface 38 of the latch 26. The door 18, 20 pushes on the sloping angle of the latch's 26 engaging surface 38 and urges the hook portion 36 away from the descending door 18, 20. When the engaging surface 38 is a radius, and the radius is equal to the distance between the top of the engaging surface 38 and the top wall portion 14, the angle of contact between the cover and the latch engaging surface 26, 38 remains more constant as the hook portion 36 is urged aside than would a simple planar pitched surface.

In opening of door 18, 20, the door's top, vis-à-vis the inclined unlocking surface 46, imposes a force on the locking surface 40 of the latch 26. The door 18, 20 pushes on the sloping angle of the latch's locking surface 26, 40 and urges the hook portion 36 away from the ascending door 18, 20. As the hook 36 is urged away, the angle of contact between the door 18, 20 and the hook 36 increases, increasing that component of the force that is deflecting the hook 36 away, and easing the continued opening of the cap 10.

Frictional forces which contribute to locking can be adjusted by, for example, the latch's locking surface 40 being inclined parallel to the door's unlocking surface 46. When the locking surface 40 and the unlocking surface 46 are parallel and meet, the contact area between the two surfaces increases. The increase in the contact of the two surfaces improves the frictional locking properties of the latch 26 by increasing the force that is required to deflect the latch 26 and free the lid portion.

Alternatively, the planes of the locking surface 40 and the unlocking surface 46 can also be skewed to minimize contact and facilitate opening the door 18, 20. The opening of the door 18, 20 can be further facilitated by providing the locking surface 40 with a steeper upward angle relative to the plane of the top wall portion 14.

Preferably, after the door 18, 20 completes urging the latch 26 away during opening or closing, the latch 26 springs back to its rest position rendering an audible indication, such as a clicking sound, that opening or closing is complete.

Except as otherwise disclosed herein, the details of a preferred execution of the non-locking aspects of a cap 10 with dual inwardly opening non-interfering door-like doors, particularly relating to the execution of the hinges 48, 50, are provided in Miller, U.S. Pat. No. 5,799,838, which patent is commonly assigned herewith, and which is incorporated by reference herein.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A locking closure for use with an associated container comprising:

a closure cap having a top wall portion and a depending skirt portion depending from the top wall portion, the top wall portion further defining a dispensing region therein;

a door for covering the dispensing region, the door having a top surface and a bottom surface defining a thickness, the door being connected to the top wall portion at a hinge region, wherein the door is pivotable about the hinge region to traverse a path between an open condition and a closed condition; and a latch having a base portion integral with the top wall and extending generally transverse therefrom, the latch further including a hook portion integral with the base portion, the hook portion extending from the base portion and intersecting the path defined by the door, the hook portion being spaced from the top wall and defining an engaging surface and a locking surface, the locking surface generally opposing the top wall portion and the engaging surface inclining downward as it extends toward the door, the latch tapering inwardly as it extends upwardly from the base portion, wherein the locking surface maintains the door in the closed condition and the engaging surface is configured to urge the hook portion out of the path of the door during closing of the door.

2. A locking closure as in claim 1, the hook portion being spaced from the top wall portion by a distance substantially equal to the thickness of the door, wherein the latch abuts the top surface of the door and the top wall portion abuts the bottom surface of the door when the door is in the closed condition.

3. A locking closure as in claim 1, the door having an edge, the door defining a deflecting surface which extends from the edge to the bottom surface, wherein the deflecting surface abuts the engaging surface and exerts a force thereon during closing, and wherein the deflecting surface provides an arcuate or sloped contact between the door and the engaging surface during closing.

4. A locking closure as in claim 3, wherein the deflecting surface is an inclined plane.

5. A locking closure as in claim 4, wherein the deflecting surface extends upwardly and outwardly from the bottom surface at an angle between 15° and 75°.

6. A locking closure as in claim 4, wherein the deflecting surface extends upwardly and outwardly from the bottom surface at an angle between 35° and 55°.

7. A locking closure as in claim 4, wherein the deflecting surface extends upwardly and outwardly from the bottom surface at an angle of about 45°.

8. A locking closure as in claim 1, the door having an edge and defining an unlocking surface, the unlocking surface extending from the top surface of the door to the edge of the door wherein the hook portion locking surface abuts the door unlocking surface when the door is in the closed condition and exerts a force thereon to maintain the door in the closed condition.

9. A locking closure as in claim 8, the hook portion being spaced from the top wall portion by a distance substantially equal to a distance between the bottom surface and the unlocking surface, wherein the latch abuts the unlocking surface while the top wall portion abuts the bottom surface of the door when the door is in the closed condition.

10. A locking closure as in claim 8, the hook portion locking surface being upwardly inclined relative to the top wall portion.

11. A locking closure as in claim 1, the top wall defining a first plane, the locking surface defining a second plane wherein an angle between first plane and the second plane is about 10°.

12. A locking closure as in claim 1, the engaging surface having an arcuate configuration.

13. A locking closure as in claim 1, the engaging surface having a radial configuration.

14. A locking closure as in claim 1 having a rim integral with the top wall portion and extending upwardly therefrom away from the skirt portion.

15. A locking closure as in claim 14, the rim having a top spaced from the top wall portion defining a first height above the top wall portion, wherein the latch extends upwardly to a second height above the top wall portion less than or equal to the first height.

16. A locking closure as in claim 1, wherein the latch is spaced from the hinge region.

17. A locking closure as in claim 1, having a second latch which is spaced from the latch and spaced from the hinge region.

18. A locking closure as in claim 1, top wall portion defining a secant line and a periphery, wherein the door has a secant edge adjacent to the secant line and a peripheral edge adjacent to a portion of the periphery.

19. A locking closure as in claim 18, having a first latch and a second latch, the first latch engaging the door on the secant edge and the second latch engaging the door on the peripheral edge.

20. A locking closure as in claim 1, wherein the latch is configured to cooperate with the door to render an audible indication that closing is complete.

21. A latch for use with an associated closure having a door that can be opened and closed, the door having a thickness, the latch comprising:

a base portion, integral with the closure;

a hook portion integral with the base portion, the hook portion having an engaging surface and a locking surface, the locking surface and engaging surface contacting the door during opening and closing respectively, the engaging surface substantially facing away from the top wall portion, the locking surface being at a height above the closure that is substantially equal to the thickness of the door and facing toward the closure, the door being held onto the associated closure by the locking surface, wherein during opening, the door applies a force to the locking surface to displace the hook portion, and wherein the latch tapers inwardly as it extends upwardly from where the base portion connects to the top wall portion so that the hook portion is more easily urged away from the door during closing when the door applies a force to the engaging surface to displace the hook portion away from the door.

22. A locking closure for use with an associated container comprising:

a closure cap having a top wall portion and a depending skirt portion depending from the top wall portion, the top wall portion further defining a first dispensing region and a second dispensing region therein;

a first door and a second door for covering the first and second dispensing regions respectively, each door having a top surface and a bottom surface defining a thickness and an edge intermediate to the top and bottom surfaces, each door being connected to the top wall portion by first and second hinge regions respectively, wherein each door is pivotable about its respective hinge region to traverse a path between an open condition and a closed condition, each door having an edge, the door defining a deflecting surface which extends from the edge to the bottom surface; and a first and second set of latches, each set of latches corresponding with a respective door, each set of latches having at least two latches spaced from the respective door's hinge region and each other, each latch having a base portion integral with the top wall portion and extending generally transverse therefrom, each latch further including a hook portion integral with the base portion, the hook portion extending from the base portion and intersecting the path defined by the respective door, the hook portion being spaced from the top wall portion by a distance about equal to the thickness, the hook portion defining an engaging surface and a locking surface, the locking surface being spaced from and generally opposing the top wall portion, the locking surface being upwardly inclined relative to the top wall portion, the engaging surface having an arcuate configuration inclining downward as it extends toward the respective door, and the latch tapering inwardly as it extends upwardly from where the base portion connects to the top wall portion, wherein the locking surface of each latch abuts the top surface of the respective door when the door is in the closed condition and maintains the door in the closed condition, and wherein the engaging surface abuts the deflecting surface when the door is closing and the deflecting surface is configured to urge the hook portion out of the path of the door during closing, and wherein the deflecting surface provides an arcuate or sloped contact between the door and the engaging surface during closing, and wherein the bottom surface of the door abuts the top wall portion when the door is in the closed condition.

* * * * *